United States Patent [19]

Stepanenko et al.

[11] Patent Number: 4,620,432

[45] Date of Patent: Nov. 4, 1986

[54] DEVICE FOR MANUFACTURING MICROWIRE

[75] Inventors: Alexandr V. Stepanenko; Vladimir G. Voitov; Viktor S. Karpitsky; Svyatoslav A. Bartashevich, all of Minsk, U.S.S.R.

[73] Assignee: Belorussky Politekhnichesky Institut, Moscow, U.S.S.R.

[21] Appl. No.: 740,296

[22] Filed: May 31, 1985

Related U.S. Application Data

[63] Continuation of Ser. No. 517,965, Jul. 28, 1983, abandoned.

[51] Int. Cl.[4] ..... B21B 31/18

[52] U.S. Cl. ..... 72/73; 72/88; 72/95; 72/199; 72/247

[58] Field of Search ..... 72/247, 406, 167, 168, 72/199, 366, 237, 214, 88, 89, 95, 73, 206; 264/280; 425/373, 374, 392; 29/110, 122

[56] References Cited

U.S. PATENT DOCUMENTS

| | | | |
|---|---|---|---|
| 2,092,188 | 9/1937 | Simons | 72/89 |
| 2,178,674 | 11/1939 | Simons | 72/243 X |
| 2,660,429 | 11/1953 | Lorig | 29/122 |
| 3,013,451 | 12/1961 | Scribner | 72/366 X |
| 3,096,672 | 7/1963 | Jones | 72/247 X |
| 3,551,976 | 1/1971 | Zentgraf et al. | 72/73 X |

FOREIGN PATENT DOCUMENTS

| | | | |
|---|---|---|---|
| 2479714 | 10/1981 | France | 72/206 |
| 0795849 | 1/1981 | U.S.S.R. | 72/89 |

OTHER PUBLICATIONS

Finishing and Hardening Rotary Treatment of Surfaces, E. G. Konovalov and V. A. Sidorenko, Higher School Publishers, Minsk, 1968, pp. 18–19 and 256–257.

*Primary Examiner*—Francis S. Husar
*Assistant Examiner*—Steve Katz
*Attorney, Agent, or Firm*—Burgess, Ryan & Wayne

[57] ABSTRACT

A deforming tool having two members of which one is made as a cylindrical roll, whereas the working surface of the other member is made curvilinear. A rod of microwire is fed into a gap between their working surfaces. A rotation drive and a drive for a reciprocating movement are mechanically coupled with the cylindrical roll.

2 Claims, 7 Drawing Figures

DEVICE FOR MANUFACTURING MICROWIRE

This application is a continuation, of application Ser. No. 517,965, filed July 28, 1983, now abandoned.

FIELD OF APPLICATION

The present invention relates to rolling and drawing mills and, more particularly, to devices for manufacturing microwire.

The present invention can find use in various fields of economy, such as radio-engineering and electronic industries, computers, machine building, medicine, chemical industry and agriculture.

PRIOR ART

The modern tendency of microminiaturing articles in all fields of engineering puts stringent requirements to production of high-quality microwire of a minimal diameter.

However, considerable forces of stretching applied for realizing a stable technological process of manufacturing microwire limit the possibility of production of such wire by means of conventional devices.

Known in the art is a device for manufacturing microwire (cf. PCT International Application No. PCT/SU80/00198 of Dec. 12, 1979, filed with the WO on Dec. 11, 1980), comprising a deforming tool having two members into the gap between the working surfaces of which a rod of wire is fed, and a drive for a reciprocating motion, which is connected to at least one member of the deforming tool. Besides, the device comprises a means for drawing microwire, arranged downstream of the deforming tool.

However, the fact that in the device the microwire has to be forcibly pulled causes, in the latter, considerable tension stresses, which results in microwire breakage and, consequently, brings down efficiency of the process.

BRIEF DESCRIPTION OF THE INVENTION

It is an object of the present invention to provide a device for manufacturing microwire, that decreases the possibility of microwire breakage.

Another object of the present invention is to raise efficiency of the technological process.

This is accomplished by a device for manufacturing microwire, comprising a deforming tool having two members in the gap between the working surfaces of which a rod of microwire is fed, and a drive for a reciprocating motion which is connected to at least one member of the deforming tool. According to the invention, one of the members of the deforming tool is made as the main cylindrical roll, whereas the working surface of the other member is made curvilinear to form together with the working surface of the main cylindrical roll a gap into which a rod of microwire is fed, and the device comprises a rotation drive mechanically coupled with the main cylindrical roll.

In the device of the invention it is expedient to make the other member of the deforming tool as a shoe whose curvilinear surface embraces a portion of the working surface of the main cylindrical roll with a gap between them decreasing in the direction of rotation of the latter.

It is desirable that in the device of the invention the deforming tool would comprise at least two sleeves embracing the main cylindrical roll at one and the same distance from its centre and and endless metal bend embracing the shoe and contacting the sleeves.

It is expedient to make the sleeves from a resilient friction material.

In accordance with the invention it is preferable to make the other member of the deforming tool as a hollow additional cylindrical roll and to additionally provide the device with a rotation drive mechanically coupled with the latter, the deforming tool being additionally provided with two axial shafts of which each is disposed inside the respective hollow cylinder and with at least two partitions each embracing the respective axial shaft and contacting the inner surface of the respective hollow cylindrical shaft.

The present invention makes it possible to bring down tension stresses in the microwire material, provides for manufacture of microwire of a smaller diameter and raises efficiency of the technological process.

BRIEF DESCRIPTION OF THE DRAWINGS

The following description of specific embodiments of the present invention is given with reference to the accompanying drawings, in which.

DETAILED DESCRIPTION OF THE INVENTION

Figure 1:
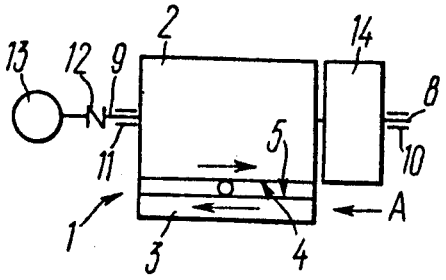
FIG. 1 shows a schematic diagram of the device of the invention for manufacturing microwire in the case when one member of the deforming member is made as a cylindrical roll and the other one as a shoe, according to the invention.

The device of the present invention used for manufacturing microwire comprises a deforming tool 1 (FIGS. 1,2) having two members made as a cylindrical roll 2 and a shoe 3, respectively, which have respective working surfaces 4 and 5. The working surface 5 of the shoe 3 is made curvilinear and embraces a part of the working surface 4 of the roll 2 with a gap between them decreasing in the direction of rotation of the roll 2 and drawing of a rod 6 of microwire 7. By its shafts 8, 9 the roll 2 is mounted in bearings 10, 11 respectively and is connected by means of a coupling 12 with a rotation drive 13. Besides, the roll 2 is connected with a drive 14 for a reciprocating motion.

In accordance with another variant of embodiment of the device for manufacturing microwire the roll 2 in the deforming tool 1 is embraced by at least two sleeves 15, 16 (FIGS. 3,4) made from a resilient friction material, such as rubber or polyurethane. The shoe 3 is embraced by an endless metal band 17 whose outer surface 18 is made as working. The band 17 is disposed on drums 19, 20, 21 which are mounted in bearings 22, 23.

In accordance with yet another variant of embodiment of the device for manufacturing microwire both members of the deforming tool 1 are made as hollow cylindrical rolls 24, 25 (FIGS. 5, 6, 7) with respective working surfaces 26, 27. The deforming tool 1 comprises axial shafts 28, 29 connected to the inner surface of the respective rolls 24, 25 by means of resilient partitions 30, 31 that embrace the shafts 28 and 29, respectively. The shaft 28 is mounted in bearings 32, 33 and is connected by means of a coupling 34 with the drive 13. The shaft 29 is mounted in bearings 35, 36 and is connected by means of a coupling 37 with a rotation drive 38, the rolls 24, 25 being connected to drives 39, 40 for a reciprocating motion. The number of the partitions 30, 31 is determined by sizes of the rolls 24, 25.

Figure 2:
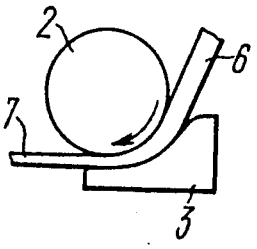
FIG. 2 is a view taken along arrow A in FIG. 1, with the drive removed.

The device for manufacturing microwire, shown in FIGS. 1, 2, operates as follows.

The rod 6 of the microwire 7 is introduced into the gap between the working surfaces 4 and 5 of the cylindrical roll 2 and the shoe 3 respectively, whereupon the rotation drive 13 is started to rotate the roll 2 in the direction of performance of the technological process. Simultaneously, the drive 14 for a reciprocating motion is started to move the roll 2 along its axis of rotation. Under the action of the drives 13 and 14 the working surface 4 of the roll 2 performs a complicated curvilinear movement due to the simultaneous rotation of the roll 2 and its reciprocating movement along the axis of its rotation. As a result, friction forces arise between the working surface 4 of the roll 2, the rod 6 and the working surface 5 of the shoe 3, under whose action the rod 6 alternately rolls into two opposite directions with the rolling length $S \geqq \pi d/2$, where d is the initial diameter of the rod 6, the latter also moving in the direction of performance of the technological process. Because of its simultaneous rolling and movement the rod 6 is gradually deformed until the microwire 7 of a round profile is formed of a diameter which corresponds to the value of the minimal gap between the working surfaces 4 and 5 of the roll 2 and the shoe 3, respectively.

The process of manufacturing the microwire 7 remains continuous until the drives 13 and 14 are turned off.

In accordance with the invention, rotation of the roll 2 in the direction of performance of the technological process contributes to a partial self-movement of the rod 6 in the area of plastic deformation, which, in turn, decreases tension stresses in the material of the microwire 7 being produced.

Figure 3:
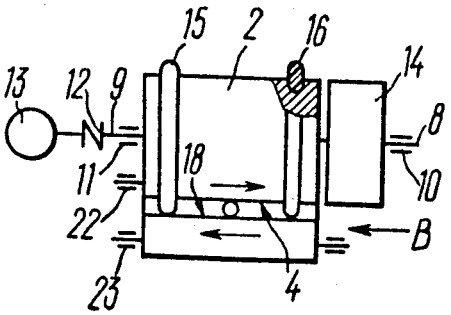
FIG. 3 shows a schematic diagram of the device of the invention for manufacturing microwire in the case when the cylindrical roll is embraced by sleeves and the shoe is an endless metal band, according to the invention.
Figure 4:
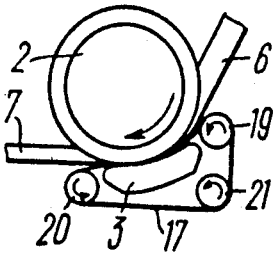
FIG. 4 is a view taken along arrow B in FIG. 3, with the drive removed.

The device for manufacturing microwire, shown in FIGS. 3 and 4 functions as follows.

The drives 13 and 14 are started. Due to the contact of the sleeves 15 and 16 with the endless metal band 17, i.e. due to arising friction forces, the band 17 also performs an intricate curvilinear movement. Because of the resilient properties of the sleeves 15 and 16 the reciprocating movement of the band 17 will be counter-phase and synchronous in relation to the similar movement of the roll 2.

In accordance with the invention, due to the synchronous rotation of both working surfaces 4 and 18 of the shaft 2 and the band 17, respectively, the present device makes it possible to still greater decrease tension stresses in the material of the microwire 7 being produced, and to improve conditions of shape-forming of the microwire 7 due to synchronization of the reciprocating axial movements of the working surfaces 4 and 18 of the roll 2 and the band 17, respectively. Otherwise, the device operates analogously to the afore-described one.

Figure 5:
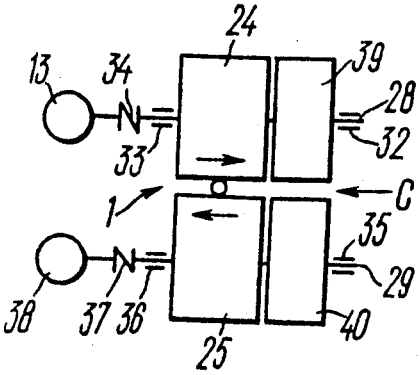
FIG. 5 shows a schematic diagram of the device of the invention for manufacturing microwire in the case when the both members of the deforming tool are made as hollow cylindrical shafts, according to the invention.
Figure 6:
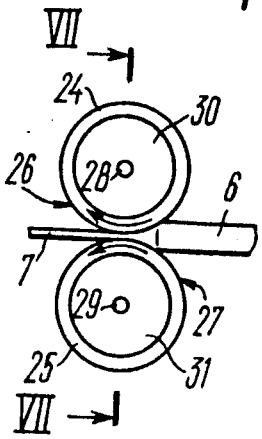
FIG. 6 is a view taken along arrow C in FIG. 5, with the drives removed.
Figure 7:
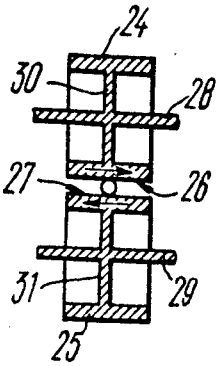
FIG. 7 is a section taken along line VII—VII in FIG. 6.

The device for manufacturing microwire, shown in FIGS. 5, 6, 7 operates as follows.

The rotation drives 13 and 38 are started to rotate the hollow cylindrical rolls 24 and 25 through the axial shafts 28, 29 and the resilient partitions 30, 31. Simultaneously, the drives 39 and 40 for a reciprocating movement are started to move the rolls 24 and 25 along their axes of rotation in a counter-phase relationship with respect to each other.

In accordance with the invention, due to the fact that the rolls 24 and 25 are made hollow, i.e. their inertia weights are decreased, and that the number of friction surfaces is reduced the device makes it possible to raise synchronization of operation of the deforming tool 1 and to increase the frequency of reciprocating movements of the working surfaces 26 and 27 of the rolls 24 and 25. This still further reduces tension stresses in the material of the microwire 7 being produced, which decreases its breakage and raises efficiency of the process. Otherwise, the device operates analogously to the afore-described one.

The present invention makes it possible to make microwire from various metals and alloys.

We claim:

1. A device for manufacturing microwire of a first diameter from a rod having a second, larger diameter, comprising:

a first cylindrical roll having a working surface;

a member having a curvilinear working surface defining together with said working surface of said cylindrical roll a gap into which said rod is fed; said member comprises a shoe having a concave curvilinear working surface which continuously embraces a portion of said working surface of said cylindrical roll to define said gap therebetween;

a first rotation drive coupled mechanically with said first cylindrical roll to advance said rod longitudinally in said gap; and a drive coupled mechanically with said first cylindrical roll to roll said rod in the course of reciprocation at a rolling distance equal to at least a half of the product of the height of said gap by the constant number $\pi$;

the gap between said member and said first cylindrical roll decreasing continuously in the direction of rotation of said first cylindrical roll;

at least two axially spaced sleeves embracing the circumference of said cylindrical roll, said two cylindrical sleeves being made of a resilient friction material and equidistant from the center of the cylindrical roll; and an endless metal band embracing said shoe and contacting said sleeves.

2. A method for manufacturing microwire having a diameter d' from a rod having an initial diameter d, comprising the steps of:

providing a rotatable cylindrical roll having a central longitudinal axis and a pair of axially spaced sleeves embracing the circumference of said cylindrical roll;

feeding the rod into a gap between the outer surface of said roll and a concave curvilinear outer surface of a support member, said gap having a height monotonically decreasing from a height at least equal to d at an entrance end of the gap to a height equal to d′ at an exit end of the gap;

rotating the roll about its central longitudinal axis in a direction such that the portion of the outer surface of the roll bounding the gap moves from the entrance end toward the exit end of the gap;

simultaneously providing relative reciprocating movement between the roll and the support member in the direction of the axis of the roll with an amplitude or rolling length at least equal to $\pi d/2$;

providing an endless flexible belt with a portion of said belt, said roll and said sleeves bounding said gap and said belt conforming to the concave curvilinear outer surface of said support member; and mounting said belt in contact with said sleeves for linear movement so that the portion of said belt bounding said gap moves at the same speed as said rod moves through said gap.

* * * * *